United States Patent [19]

Zehren

[11] 4,021,137

[45] May 3, 1977

[54] STORM CHOKE APPARATUS FOR SUBMERGIBLE PUMPS

[75] Inventor: James N. Zehren, Bartlesville, Okla.

[73] Assignee: TRW Inc., Cleveland, Ohio

[22] Filed: Sept. 24, 1975

[21] Appl. No.: 616,321

[52] U.S. Cl. ..... 415/147; 417/424; 166/325; 415/158

[51] Int. Cl.[2] ..... F04D 25/00

[58] Field of Search ..... 415/147, 146, 158; 166/224 R, 224 A; 251/63.5; 417/424

[56] References Cited

UNITED STATES PATENTS

| | | | |
|---|---|---|---|
| 540,003 | 5/1895 | Reed | 251/63.5 |
| 2,848,053 | 8/1958 | Curry | 166/224 |
| 3,246,606 | 4/1966 | Nielsen | 415/146 |
| 3,658,440 | 4/1972 | Jackson | 415/147 |
| 3,672,795 | 6/1972 | Arutunoff et al. | 417/424 |
| 3,807,894 | 4/1974 | O'Rourke | 415/147 |

FOREIGN PATENTS OR APPLICATIONS

| | | | |
|---|---|---|---|
| 512,895 | 2/1955 | Italy | 251/63.5 |

*Primary Examiner*—Henry F. Raduazo
*Attorney, Agent, or Firm*—Shapiro and Shapiro

[57] ABSTRACT

A choke valve (safety valve) is provided in association with a submergible pump employed in oil wells or the like to prevent the flow of well fluid toward the well head when the pump is not operating. Differential pressure across the pump is employed to open the valve, and the valve closes automatically when the pump is de-energized. Bottom-hole pressure merely closes the valve more tightly. A reciprocating tapered valve member controls the opening and closing of a longitudinal passage through a tubular valve housing, the differential pump pressure being applied across an annular piston reciprocating in an annular chamber surrounding the longitudinal passage and connected to the valve member by a plurality of longitudinal piston rods, springs surrounding the piston rods biasing the valve member to a closed position. The storm choke can be operated by fluid pressure applied from the earth's surface in order to permit "killing the well" or flushing sand from the choke.

11 Claims, 1 Drawing Figure

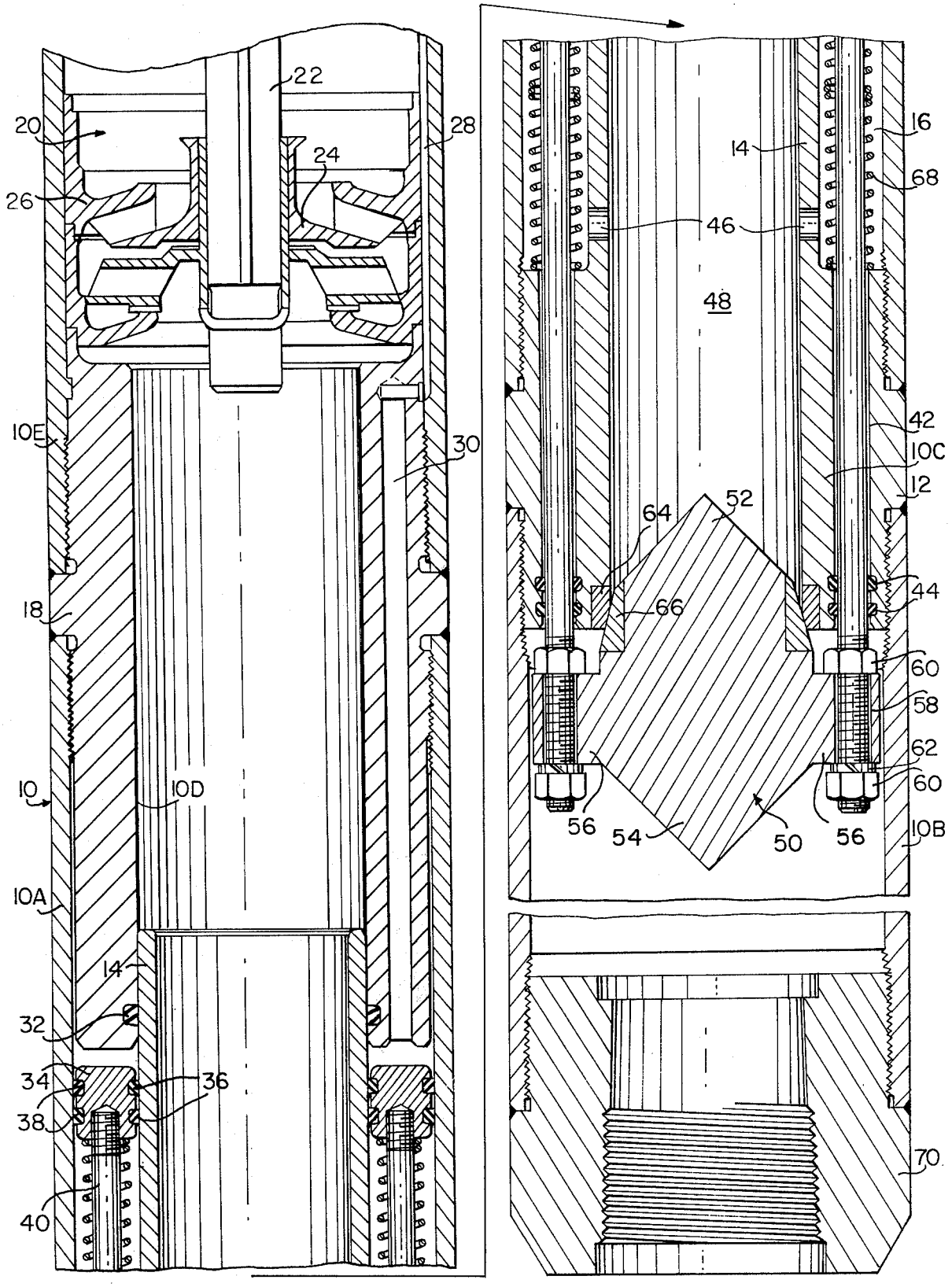
22
20
28
24
26
10E
30
18
10
10D
10A
14
32
34
36
38
40
16
14
68
46
48
42
10C
12
52
64
44
66
60
58
62
60
56
54
50
56
10B
70

STORM CHOKE APPARATUS FOR SUBMERGIBLE PUMPS

BACKGROUND OF THE INVENTION

This invention relates to storm chokes or safety valves and is more particularly concerned with well valves which open automatically when a submergible pump is actuated but which otherwise remain closed.

It is common practice to provide an oil well or the like with a device known as a storm choke or safety valve for blocking the path by which the well fluid may flow to the earth's surface when such flow is not desired. For example, it is well known to provide well safety or blow out control valves which may be operated by a wire line, by hydraulic or pneumatic pressure transmitted from the surface, or in response to well flow rate or pressure parameters to shut off the flow of well fluid to the surface when such flow would be undesirable or dangerous. Devices of this type tend to be complicated, expensive, unwieldy, and/or unreliable. It is known to employ various types of valves in conjunction with pumps, but in general, such devices are not suited for use as effective storm chokes in connection with submergible pumps.

U.S. Pat. No. 3,807,894 to O'Rourke, assigned to the assignee of the present invention, discloses and claims improved storm chokes which open automatically in response to the operation of an associated submergible pump and which are attached to or form part of the inlet or outlet housing of the pump. All of the choke parts are adjacent to the pump and not dependent upon connections to distant operators. The chokes are normally closed by biasing springs and remain firmly closed under bottom-hole pressure, but they are readily opened in response to differential pumping pressure or pressure applied from the earth's surface. Reference is made to the prior art cited in the O'Rourke patent, and in addition, to the following prior patents, which are typical of the prior art:

U.S. Pat. No. Re 25,109—Natho
U.S. Pat. No. 3,610,569—Reaves
U.S. Pat. No. 3,640,303—Verheul
U.S. Pat. No. 3,747,618—Boes
U.S. Pat. No. 3,007,524—Pistole et al.
U.S. Pat. No. 3,294,174—Vincent
U.S. Pat. No. 3,698,426—Litchfield et al.
U.S. Pat. No. 3,698,411—Garrett
U.S. Pat. No. 1,631,509—Baker
U.S. Pat. No. 3,084,898—Miller
Canadian Pat. No. 749,740

SUMMARY OF THE INVENTION

It is a principal object of the present invention to provide improved storm choke apparatus or the like which is somewhat simpler than the apparatus disclosed in the aforesaid O'Rourke patent, which employs a large diameter, longitudinal, central flow passage with minimal flow obstruction when the valve is open, and which has most of the advantages of the O'Rourke invention.

Briefly stated, the storm choke of the invention employs a valve associated with a submergible pump which is located above the valve. When the pump is actuated, the differential pressure across the pump is applied to a valve operating piston which opens the valve. The operating piston is annular and is located in an annular chamber surrounding a large diameter, central, longitudinal flow passage in the valve housing. Piston rods connect the piston to a valve member which is biased to a closed position against an annular seat by springs surrounding the piston rods. A passage in a wall of the housing connects the discharge side of the pump to the chamber at one side of the piston, the opposite side of the piston being exposed to the pump input pressure.

BRIEF DESCRIPTION OF THE DRAWING

The invention will be further described in conjunction with the accompanying drawing, the sole FIGURE of which is a contracted longitudinal sectional view of the invention.

DETAILED DESCRIPTION OF THE INVENTION

Referring to the drawing, storm choke or safety valve apparatus of the invention comprises an elongated tubular housing 10 of generally cylindrical shape and having an upper portion 10A and a lower portion 10B joined by a threaded adapter sleeve 10C. As shown, the adapter sleeve has an annular flange 12 against which opposing ends of housing sections 10A and 10B are abutted, the sleeve, which also forms part of the housing, being externally threaded at opposite sides of the flange for engagement with the internal threads of the housing sections 10A and 10B. In the form shown, the adapter sleeve 12 has a cylindrical extension 14 spaced inwardly of and coaxial with the housing section 10A to form sides of an annular chamber 16, the lower end of which is closed by the adapter sleeve and the upper end of which is closed by a further adapter sleeve 10D, forming part of the housing. Sleeve 10D has an annular flange 18 against which are abutted the upper end of housing section 10A and the lower end of a further housing section 10E, Which is part of the housing of a submergible pump 20. Housing sections 10A and 10E are threadedly engaged with housing section 10D in the same manner that housing section 10C is engaged with sections 10A and 10B.

The pump is preferably of the centrifugal type, comprising a central pump shaft 22 on which impellers 24 are mounted. The impellers cooperate with diffusers 26 mounted on the housing of the pump (including section 10E). Only a few of the impellers and diffusers are shown in order not to complicate the drawing. The pump shaft is supported upon the usual bearing spiders and is coupled at its upper end to an electric motor (not shown) located in the pump housing or in a housing fixed to the uppermost state of the pump. Pumps of the type illustrated are disclosed, for example, in U.S. Pat. Nos. 2,775,945; 2,270,666; and 2,236,887. The discharge side of pump 20 is connected to chamber 16 by a longitudinal passage 28, 30, the portion 28 of the passage being formed in the wall of housing section 10E, and the portion 30 being formed as a bore extending through the adapter sleeve 10D. An O-ring seal is provided between the lower end of adapter sleeve 10D and the upper end of cylindrical extension 14, as shown at 32.

Annular chamber 16 contains an annular piston 34 having inner piston rings 36 and outer piston rings 38 sealing against the inner and outer surfaces of the chamber. Four piston rods 40 spaced at 90° intervals around the piston 34 are threaded into the piston at one end of the rods. The piston rods extend longitudinally through chamber 16 and then through corresponding bores 42 in adapter sleeve 10C, O-ring seals 44 surrounding each of the piston rods near the lower end thereof. Chamber 16 is provided with one or more vent or balancing ports 46 which may open to the interior of the housing constituted by a single, large-diameter, central, longitudinal flow passage 48. As shown, chamber 16 is located laterally outward of flow passage 48, between pump 20 and the lower end of sleeve 10C. At their lower end, piston rods 40 are connected to and support an axially reciprocating valve member 50. The valve member may be an annular plug with upwardly and downwardly extending tapered portions 52 and 54, respectively, and with four radial arms 56 provided with bores 58 receiving the piston rods 40. The piston rods are threaded and provided with upper and lower nuts 60 and with lock washers 62 for connecting the piston rods to the valve member 50. The lower end of sleeve 10C is provided with a circumferential seat 64 engaging an annular sealing portion 66 of valve member 50. Coil compression springs 68 surrounding the piston rods 40 apply an upward force to piston 34 for normally closing the valve. The lower end of housing 10B may be threadedly engaged with a base nipple 70.

The entire pump installation, including the choke, pump stages, motor, and auxiliary apparatus may be suspended in a well from a cable, as taught, for example, in U.S. Pat. Nos. 3,672,795; 3,468,258; and 3,411,454, and the fluid discharge of the pump may flow to the surface through the well casing or a liner, as disclosed in those patents, or through a conventional tubing string.

In operation, it is assumed that housing 10 is submerged in and contains well fluid. When the pump 20 is actuated, the output pressure is applied through passage 28, 30 to the upper side of piston 34, moving this piston downwardly to open the valve member 50 and provide full flow through housing 10 from the space below the valve member to the space above the valve member. Fluid trapped in chamber 16 is vented by means of ports 46. As long as the pump is operating, the differential pressure across the pump is sufficient to maintain valve member 50 open against the bias of springs 68, the top of piston 34 being subjected to the output pressure and the bottom of the piston being exposed to the input pressure of the pump. Enough stages of impeller-diffuser units are provided to insure that the differential pressure exerted upon the valve member is sufficient to open the valve member and maintain the valve open during pumping. When the pump is de-energized, however, springs 68 move piston 34 upwardly, closing valve member 50 against its seat. Bottom-hole pressure exerted against the lower surfaces of the valve member merely closes the valve more tightly. However, valve member 50 may be opened by fluid pressure applied to the top of the valve member from the earth's surface in order to "kill the well" or to flush sand from the vicinity of the valve member.

By virtue of the invention, a simple, yet highly effective storm choke or safety valve is provided in association with a submergible pump, the valve opening automatically when the pump is operating, to provide substantially unimpeded full-flow operation, and the valve closing automatically and remaining closed when the pump ceases to operate. Yet, the valve can be opened when desired, by application of fluid pressure from the earth's surface. The valve member is moved evenly by the operating rods at opposite sides thereof, and the rods do not occupy space in the flow passage. Moreover, the valve is easily manufactured, the housing parts being threaded together and the chamber for the operating piston being formed automatically when the housing parts are assembled.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. Storm choke apparatus for use with submergible pump means, comprising a tubular housing associated with said pump means and adapted to be submerged in a fluid to be pumped therethrough, said housing having a longitudinal fluid flow passage therethrough with a circumferential valve seat, an axially reciprocating valve member which, when in a closed position, engages said seat and isolates a space in said housing at one side of said member from a space at a different side of said member, operating means coupled to said valve member and responsive to differential pumping pressure across said pump means for moving said valve member to an open position away from said seat for providing communication between said spaces, and means coupled to said valve member for moving said valve member to said closed position in the absence of said differential pumping pressure, said different side of said valve member being exposed to said fluid to be pumped and responding to the pressure thereof, when said valve member is in closed position, for holding said valve member in said closed position more tightly, said operating means comprising piston means supported for reciprocation in chamber means located laterally outward of said longitudinal passage, said piston means having a plurality of rods extending axially of said housing at opposite sides of said passage, connected to said piston means at one end thereof, and connected to said valve member at the opposite end thereof.

2. Apparatus in accordance with claim 1, wherein said piston means and said chamber means are annular and surround said longitudinal passage.

3. Apparatus in accordance with claim 1, wherein said pump means is located in said housing at said one side of said valve member for pumping fluid away from said valve member and has a passage connecting said chamber means to the discharge side of said pump means.

4. Apparatus in accordance with claim 3, wherein said pump means comprises rotary pump elements fixed to a shaft in said housing extending along the length thereof.

5. Apparatus in accordance with claim 4, wherein said chamber means is located between said pump means and said valve member.

6. Apparatus in accordance with claim 1, wherein said means for moving said valve member to said closed position comprises a biasing spring.

7. Apparatus in accordance with claim 1, comprising means for providing communication between said spaces in response to fluid pressure exerted in said housing at said one side of said valve member.

8. Apparatus in accordance with claim 7, wherein the last-mentioned means comprises means for applying fluid pressure to said valve member at said one side to move said valve member to an open position.

9. Apparatus in accordance with claim 1, wherein said housing comprises a pair of aligned connected sections, one of which has a wall spaced inwardly from a wall of the other to define sides of said chamber means.

10. Apparatus in accordance with claim 9, wherein one of said sections has a wall extending between the aforesaid walls to define an end of said chamber means.

11. Apparatus in accordance with claim 10, wherein said housing comprises a further section aligned with and connected to said pair of sections, said further section extending between the first-mentioned walls to define an end of said chamber means spaced from the first-mentioned end.

* * * * *